United States Patent [19]

Koshimura et al.

[11] Patent Number: 4,860,369

[45] Date of Patent: Aug. 22, 1989

[54] FLAT SPEAKER UNIT

[75] Inventors: Katsumi Koshimura, Tokyo; Akio Koike, Tokorozawa, both of Japan

[73] Assignee: Kabushiki Kaisha Seidenko, Tokyo, Japan

[21] Appl. No.: 36,340

[22] Filed: Apr. 9, 1987

[51] Int. Cl.[4] ..... H04R 1/02

[52] U.S. Cl. ..... 381/188; 381/87; 181/148

[58] Field of Search ..... 381/188, 87, 88; 248/27.1, 27.3, 590; 411/340, 341, 342, 349; 181/148, 150, 191

[56] References Cited

U.S. PATENT DOCUMENTS

| | | | |
|---|---|---|---|
| 1,997,408 | 4/1935 | Holmes | 381/188 |
| 2,224,023 | 12/1940 | Sayen et al. | 411/342 |
| 2,917,267 | 12/1956 | Riddle | 248/27.1 |
| 4,228,327 | 10/1980 | Sawafuji | 381/196 |
| 4,484,658 | 11/1964 | Grote | 381/188 |
| 4,672,675 | 6/1987 | Powell et al. | 318/188 |

FOREIGN PATENT DOCUMENTS

| | | | |
|---|---|---|---|
| 2520181 | 7/1983 | France | 381/188 |

*Primary Examiner*—David K. Moore
*Assistant Examiner*—Alvin Oberley
*Attorney, Agent, or Firm*—Ladas & Parry

[57] ABSTRACT

A flat speaker device having a flat speaker unit fitted into a through-hole for mounting a speaker of a wall surface board having its back secured to a wall surface leaving a specific spacing therebetween, the flat speaker unit comprising a total-drive type flat speaker comprising a plurality of magnets juxtaposed on a plane and a diaphragm formed from a plurality of projections for respectively covering the plurality of magnets, a speaker frame with a mounting flange mounted on the flat speaker so as to encircle the outer periphery of the flat speaker, rod-like screw members mounted so as to pass through the speaker frame from the front surface towards the back, and swining blades each disposed on the back of the speaker frame with one end threadedly engaged with a respective rod-like screw member and having a length such that when the blade is swung outwardly of a diagonal line of the speaker frame, the tip portion of the blade extends outwardly from the speaker frame.

8 Claims, 3 Drawing Sheets

FLAT SPEAKER UNIT

BACKGROUND OF THE INVENTION

The present invention relates to flat speaker devices of type adapted to be embedded in flat wall surfaces or the like for use, and more particularly to a flat speaker device which has an excellent aesthetic appearance and can produce an excellent acoustic effect.

A flat speaker of total-drive type in which a plurality of magnets are juxtaposed at regular intervals on a flat plate, each of said magnets being covered with an inverted-U shaped (projection) vibration structure or diaphragm, and the diaphragm is vibrated to obtain a reproduced sound has been known (for example, as disclosed in U.S. Pat. No. 4,228,327 and Japanese Patent No. 1,172,546).

The total-drive type flat speaker possesses the characteristic whereby the thickness thereof may be materially reduced as compared with a generally used so-called concentrated-drive type speaker having a voice coil. A variety of modes of installation and methods of use have been studied by making use of the aforesaid characteristic. For example, if the flat speaker is embedded flush into a wall surface so as to form a part of the wall surface, an acoustic room can be constituted wherein the speaker is not projecting out from the wall surface, and excellent exterior appearance is obtained. In addition, if a number of flat speakers are embedded in a wall surface, varied acoustic effects may be obtained. It is very difficult for a conventional type speaker to be used in such a manner because it has a greater front-to-back depth necessitating a large cavity to be provided in the wall.

Furthermore, the larger the speaker, the better its performance in the low sound region, but in an ordinary system there is a disadvantage in that the installation space increases.

SUMMARY OF THE INVENTION

It is an object of the present invention to provide a flat speaker device which has excellent appearance and can produce an excellent acoustic effect.

It is a further object of the present invention to provide a speaker unit in which a total-drive type flat speaker may be simply and easily mounted in the wall surface.

According to the present invention, there is provided a flat speaker which is mounted in a wall surface of the like, comprising a wall surface board having its back secured to the wall surface leaving a specific spacing with respect to the wall surface and formed with a through-hole used to mount a speaker, and a total-drive type flat speaker fitted into and fixedly mounted on the through-hole of the wall surface board.

According to the present invention, there is further provided a flat speaker unit which comprises a total-drive type flat speaker comprising a plurality of magnets juxtaposed on a plane and a diaphragm formed from a plurality of projections for respectively covering said plurality of magnets, a speaker frame having a mounting flange mounted on the flat speaker so as to encircle the outer periphery of the flat speaker, rod-like screw members mounted so as to pass through the speaker frame from the front surface towards the back, and swinging blades disposed on the back of the speaker frame, one proximal end of each blade being threadedly engaged with the rod-like screw member, each blade having a length such that when said blade is swung outwardly of the diagonal line of the speaker frame, the distal tip portion thereof extends outwardly from the speaker frame.

DESCRIPTION OF THE PREFERRED EMBODIMENTS

Figure 1:
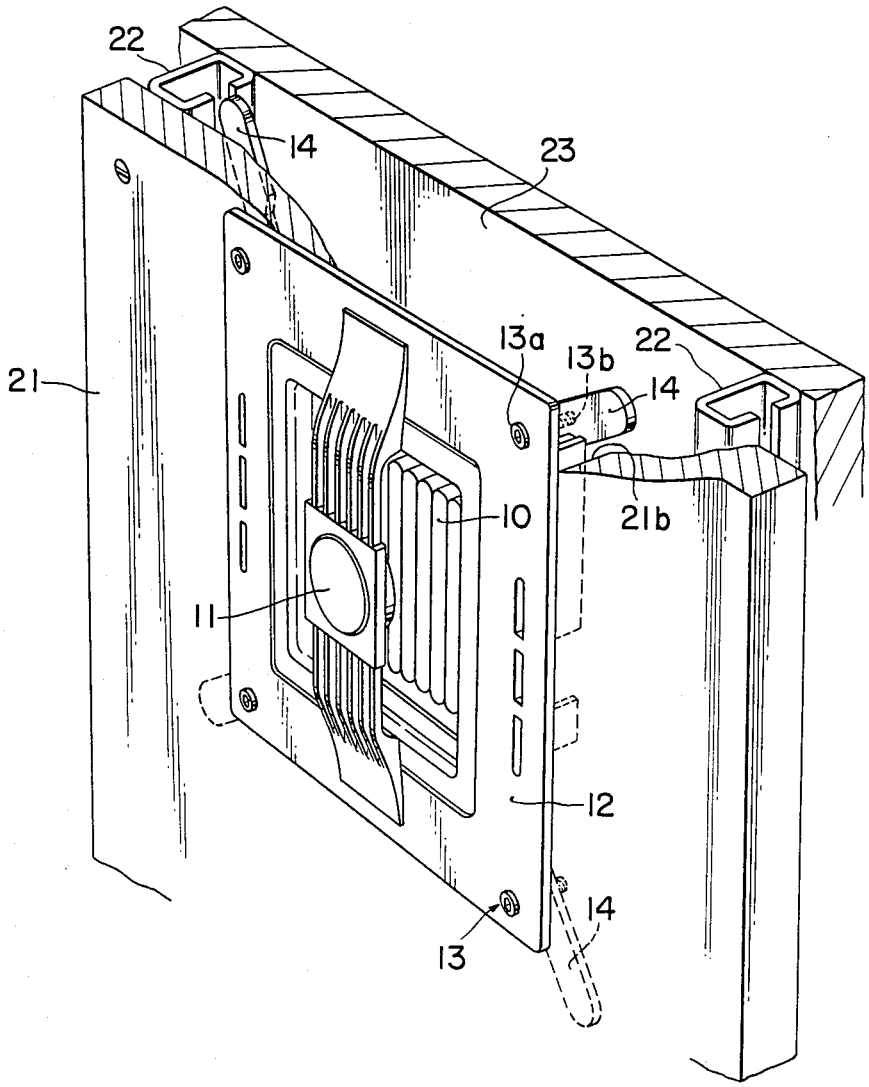
FIG. 1 is a perspective view, including a partial section, showing an embodiment of a flat speaker device according to the present invention.
Figure 3:
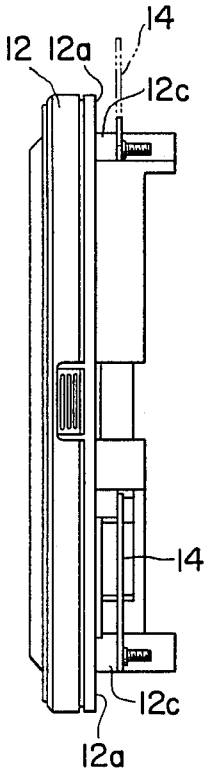
FIG. 3 is a side view of the flat speaker unit shown in FIG. 2.

Preferred embodiments of the present invention will now be described with reference to the accompanying drawings. A total-drive type flat speaker 10 comprising a plurality of magnets juxtaposed on a flat plate and a diaphragm formed from a plurality of projections for covering the plurality of magnets is of a generally square shape, and a speaker frame 12 is mounted so as to surround the outer periphery thereof. A tweeter 11 for sounds of high pitch is disposed approximately in the middle of the flat speaker 10 so as to span the speaker frame 12. The speaker frame 12 is provided with a mounting flange 12*a* in contact with a wall surface and a connecting portion 12*b* (see FIG. 5) to which is connected a flange portion of the flat speaker 10 formed internally of the flange portion 12*a*, which are constituted into an approximately square frame body. Bosses 12*c* through which bolts extend are provided on four corners between the mounting flange portion 12*a* and connecting portion 12*b* of the speaker frame 12.

The bosses 12*c* are each formed with a through-hole which extends from the front surface to the back of the speaker frame 12, and a rod-like screw thread member, for example, a bolt 13 is inserted through said through-hole in such a manner that its head 13*a* and threaded portion 13*b* will be positioned at the front surface of the speaker frame 12 and at the back of the speaker frame 12, respectively.

A swinging blade 14 in the form of an elongated plate is rotatably mounted on the threaded portion 13*b* of the bolt 13 in a direction at right angles to the bolt 13 by bringing an internal thread portion 15 formed on one end thereof into threaded engagement with the threaded portion 13*b*.

Figure 5:
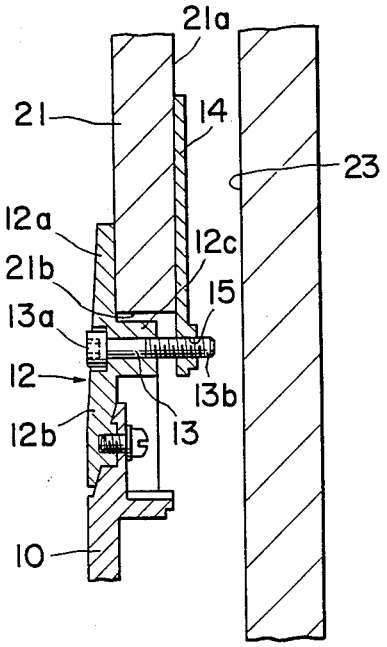
FIG. 5 is a fragmentary sectional view showing the state wherein a speaker frame is mounted and secured to a wall surface board by a swinging blade.
Figure 6:
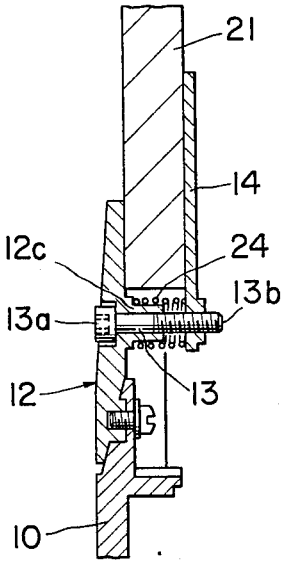
FIG. 6 is a fragmentary sectional view showing another example of a mounting mechanism for the wall surface by way of the swinging blade.

As shown in FIGS. 5 and 6, the internal thread portion 15 of the swinging blade 14 is formed to have a great thickness and is provided with a slot 15*a*. The inner diameter of the internal thread portion 15 is formed slightly smaller than the outside diameter of the threaded portion 13*b* of the bolt 13, whereby the threaded portion 13*b* is resiliently held by the internal thread portion 15, and the swinging blade 14 can be positively mounted on the bolt 13 without being loosened. The swinging blade 14 has a length such that when the blade is swung outwardly of the diagonal line of the speaker frame 12, a specific length, for example, half of the length of the swinging blade 14 extends outwardly of the speaker frame 12. Each swinging blade 14, when not in use, is folded inwardly of the speaker frame 12 and locked in the state where the tip thereof is placed in contact with a projected portion 12*d* provided on the back of the speaker frame 12. This locking can be carried out by turning the bolt 13 to move the swinging blade 14 to the projected portion 12*d* of the speaker frame 12. A stop 16 for determining the swinging position of the swinging blade 14 is provided in the vicinity of the boss 12*c* of the speaker frame 12.

In the figure, a wall surface board indicated at 21 is provided for mounting of the flat speaker 10 and is secured to a wall surface of a building or a wall surface 23 used for a partition or the like by use of a frame material such as a channel member 22 in such a manner that the back 21*a* has a specific spacing (for example, a spacing within which the swinging blade 14 can be rotated) with respect to the wall surface 23. The wall surface board 21 is provided with a through-hole 21*b* for mounting the flat speaker 10.

Figure 2:
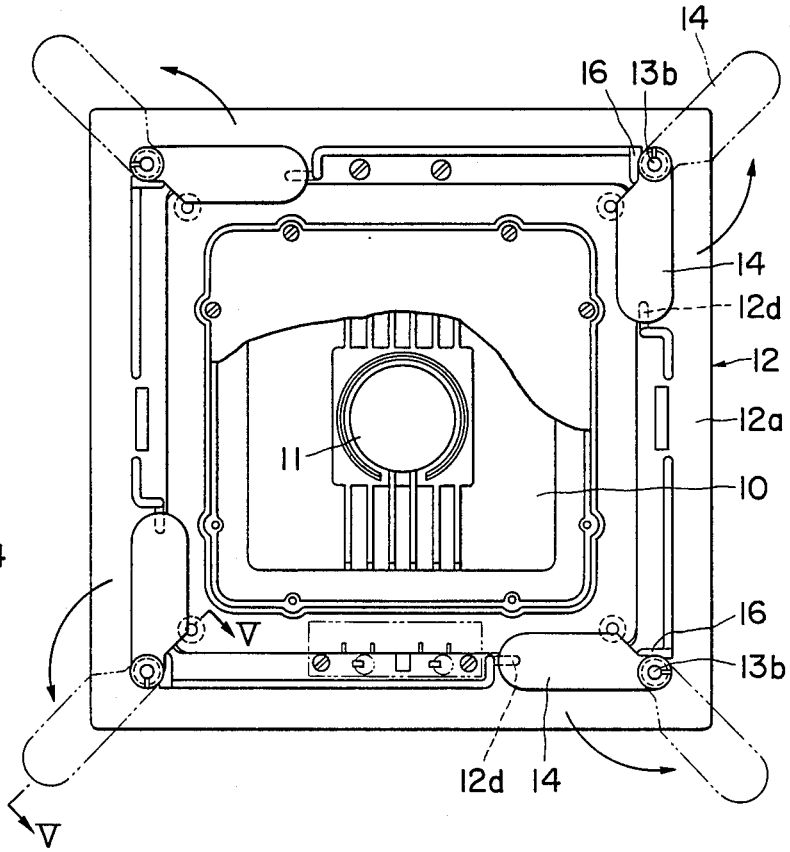
FIG. 2 is a rear view, partly cutaway, showing an embodiment of a flat speaker unit according to the present invention.
Figure 4:
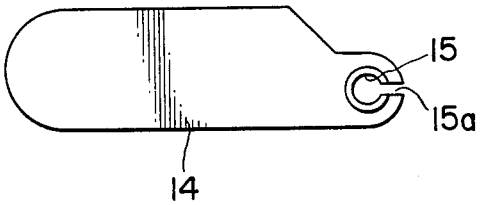
FIG. 4 is a front view showing one example of a swinging blade.

The mounting of the flat speaker 10 to the wall surface board 21 is carried out by first folding the swinging blades 14 inwardly of the speaker frame 12, allowing the tip of each blade to be locked while being placed in contact with the projected portion 12*d* by the fastening force of the bolt 13, and fitting the speaker frame 12 into the through-hole 21*b*. Next, the mounting flange portion 12*a* of the speaker frame 12 is placed in contact with the wall surface board 21, and in this state, each bolt 13 is turned in the direction for loosening it to enlarge the spacing between the head 13*a* of the bolt 13 and the swinging blade 14. When the bolt 13 is pushed in along the through-hole provided in the boss 12*c* of the speaker frame 12, the swinging blade 14 is moved away from the projected portion 12*d* and moved backward to the position of the back of the wall surface board 21. Next, the bolts 13 are turned in the direction for tightening them so as to impart a torsional force and swing the blades 14 in the direction as indicated by the arrows in FIG. 2. Each swinging blade 14 swings until it is stopped by the stop 16 and moves beyond the mounting flange portion 12*a* of the speaker frame 12 to assume an outwardly extended configuration.

When each bolt 13 is further turned in the direction for tightening it, the swinging blade 14 moves toward the bolt head 13*a* while maintaining its extended state and comes into contact with the back of the wall surface board 21. Subsequently, when the bolt 13 is tightened, the wall surface board 21 is firmly sandwiched between the mounting flange portion 12*a* of the speaker frame 12 and the swinging blade 14, and the speaker frame 12 is secured to the wall surface board 21.

As described above, according to the above described embodiment of the invention, the speaker frame 12 can be simply and easily mounted on and secured to the wall surface board 21 without the provision of a tapped hole or the like. Also, the speaker unit can be mounted without the use of a special mounting device, whereby the mounting space can be kept at a minimum. Since the mounting can be performed without the provision of a tapped hole in the wall surface board 21, even if the wall surface board 21 is formed of a relatively soft material causing difficulty in machining a tapped hole or a material such as plaster which cannot be machined to form a tapped hole, the speaker unit can be readily secured thereto.

The speaker unit mounted on the wall surface board 21 in the manner as described above projects merely slightly outward from the surface of the wall surface board 21, and one may make the best use of the characteristic of the flat speaker whereby the installation space can be reduced. In addition, the wall surface board 21 may be utilized as a baffle plate for the speaker to materially enhance the performance of the speaker, particularly the performance in the low sound region. The wider the wall surface board 21, the more effective, and even a small flat speaker 10 can obtain a better acoustic effect without increasing the installation space therefor. Moreover, the flat speaker may be utilized as a part of the wall surface to obtain an acoustic room of excellent aesthetic appearance.

FIG. 6 is a fragmentary sectional view showing another embodiment of the present invention. In this embodiment, a coil spring 24 is disposed between the back of the speaker frame 12 and each swinging blade 14 and at its opposite ends abuts against and is connected to the back of the speaker frame 12 and the base end of the swinging blade 14, respectively. The coil spring 24 is preferably so disposed as to encircle the outer periphery of the boss 12*c* of the speaker frame 12.

By provision of this coil spring 24, each swinging blade 14 is constantly biased in the axial direction of the bolt 13 by the spring force so that the movement of the swinging blade 14 in the axial direction of the bolt 13 is smooth. Further, the swinging blade 14 can be maintained in the state where it is folded by the torsional force of the coil spring 24, and the mounting of the speaker frame 12 onto the wall surface board 21 is smoothly carried out without being obstructed by a carelessly extended swinging blade 14. Furthermore, even if a swinging blade 14 is erroneously disengaged from the threaded portion 13*b* of the bolt 13, it will not fall off and be lost.

It is to be noted in the example shown in FIG. 6 that the opposite ends of the coil spring 24 are not connected to the back of the speaker frame 12 and the base end of the swinging blade 14, respectively, but the spring is merely disposed abuttingly therebetween. Even this arrangement is effective in smoothly carrying out the axial and rotational movements of the swinging blade 14.

While in the above described embodiment of the invention, an example has been shown in which the speaker frame 12 is mounted on a wall surface board 21, it is noted that a plate or a C-shaped channel other than a wall may be used to assemble a wall surface, to which the speaker frame can be simply mounted. Moreover, since speaker units may be mounted close to each other, many speaker units can be arranged closely in the wall surface, whereby an acoustic effect with a distinctive feature that cannot be obtained by a single speaker can be obtained.

What is claimed:

1. A flat speaker unit comprising:

a speaker frame having a mounting flange connectable to a wall surface and having a front portion, a back portion and a connecting portion on an inner periphery of the speaker frame;

a total-drive type flat speaker, mounted to the connecting portion, comprising a plurality of magnets juxtaposed on a plane surface and a diaphragm formed from a plurality of projections for respectively covering said plurality of magnets;

a rod-like screw member mounted within at least one opening in the speaker frame so as to pass through the speaker frame from the front portion towards the back portion;

at least one swinging blade adjacent to the back portion of the speaker frame and having a proximal end and a distal tip portion, wherein the proximal end of each blade has a threaded aperture so to threadedly engage the rod-like screw member, and wherein each blade has a length such that when said blade is radially swung outward from the speaker frame the distal tip portion thereof extends outwardly from the speaker frame; and at least one coil spring disposed between each swinging blade and the back portion of the speaker frame wherein said coil spring abuts the back portion of the speaker frame and the proximal end of the swinging blade, and encircles the rod-like screw member, so as to exert axial and rotational forces on the swinging blade.

2. A flat speaker unit according to claim 1, wherein said proximal end of the swinging blade is formed to have a greater thickness than the distal tip portion thereof.

3. A flat speaker unit according to claim 2, wherein a tweeter speaker, attachable to the total-drive type flat speaker, is positioned in front of the total-drive type flat speaker.

4. A flat speaker unit according to claim 3, wherein the spring is fixed to the back portion of the speaker frame and the swinging blade so that swinging blade remains attached to speaker frame if the rod-like screw member is disengaged from the swinging blade.

5. A flat speaker unit comprising:

a speaker frame having a mounting flange connectable to a surface board and having a front portion, a back portion, and a connecting portion on a inner periphery of the speaker frame, and wherein the surface board is connectable to a wall surface;

a total-drive type flat speaker mounted to the connecting portion, comprising a plurality of magnets juxtaposed on a plane surface and a diaphragm formed from a plurality of projections for respectively covering said plurality of magnets;

a rod-like screw member mounted within at least one opening in the speaker frame so as to pass through the speaker frame from the front portion towards the back portion;

at least one swinging blade adjacent to the back portion of the speaker frame and having a proximal end and a distal tip portion, wherein the proximal end of each blade has a threaded aperture so as to threadedly engage the rod-like screw member, and wherein each blade has a length such that when said blade is radially swung outward from the speaker frame the distal tip portion thereof extends outwardly from the speaker frame; and a coil spring disposed between the swinging blade and the back portion of the speaker frame, wherein said coil spring abuts the back portion of the speaker frame and the proximal end of the swinging blade, and encircles the rod like screw member, so as to exert axial and rotational forces on the swinging blade.

6. A flat speaker unit according to claim 5, wherein said proximal end of the swinging blade is formed to have a greater thickness that the distal tip portion.

7. A flat speaker unit according to claim 6, wherein a tweeter speaker, attachable to the total-drive type flat speaker, is positioned in front of the total-drive type flat speaker.

8. A flat speaker unit according to claim 7, wherein the spring is fixed to the back portion of the speaker frame and the swinging blade so that swinging blade remains attached to speaker frame if the rod-like screw member is disengaged from the swinging blade.

* * * * *